United States Patent [19]

Hradil et al.

[11] 4,126,524

[45] Nov. 21, 1978

[54] SILVER COMPLEX, METHOD OF MAKING SAID COMPLEX AND METHOD AND ELECTROLYTE CONTAINING SAID COMPLEX FOR ELECTROPLATING SILVER AND SILVER ALLOYS

[75] Inventors: Edward Hradil; Hana Hradil, both of Warwick; Alfred M. Weisberg, Providence, all of R.I.

[73] Assignee: Technic, Inc., Providence, R.I.

[21] Appl. No.: 662,511

[22] Filed: Mar. 1, 1976

Related U.S. Application Data

[63] Continuation-in-part of Ser. No. 557,768, Mar. 12, 1975, abandoned.

[51] Int. Cl.[2] ..... C25D 3/46; C25D 3/64; C07D 207/32; C07D 207/44

[52] U.S. Cl. ..... 204/44; 204/43 R; 204/46 R; 260/326.5 A

[58] Field of Search ..... 204/46 R, 43 R, 44, 204/109; 260/326.5 A

[56] References Cited

U.S. PATENT DOCUMENTS

| | | | |
|---|---|---|---|
| 3,238,112 | 3/1966 | Haslam | 204/46 R X |
| 3,293,157 | 12/1966 | Facsko et al. | 204/46 R |
| 3,362,895 | 1/1968 | Foulke | 204/43 R |

FOREIGN PATENT DOCUMENTS

| | | | |
|---|---|---|---|
| 939,720 | 3/1956 | Fed. Rep. of Germany | 204/46 R |

*Primary Examiner*—G. L. Kaplan
*Attorney, Agent, or Firm*—Eugene E. Geoffrey, Jr.

[57] ABSTRACT

A non-cyanide silver and silver-alloy electroplating bath composed of silver salts with imides of organic dicarboxylic acids which form a useful complex. Alloy deposits of silver with up to 5 percent of Copper, Cadmium, Gold, Antimony, Palladium and similar related metals can be prepared.

41 Claims, No Drawings

SILVER COMPLEX, METHOD OF MAKING SAID COMPLEX AND METHOD AND ELECTROLYTE CONTAINING SAID COMPLEX FOR ELECTROPLATING SILVER AND SILVER ALLOYS

Related Application:

This is a continuation in part of our patent application Ser. No. 557,768, Filed Mar. 12, 1975, assigned to Technic, Inc., Cranston, Rhode Island and now abandoned.

DETAILED DESCRIPTION OF THE INVENTION

The reaction products of a water soluble silver salt pyrrolidine-2,5 diones (pyrrolidine 2,5 diones) or 3-pyrroline-2,5 diones (2,5-pyrrolediones). are useful, more particularly, the following five member heterocyclic ring compounds may be used to complex silver ions:

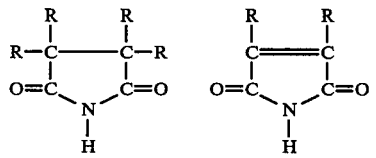

wherein R is —H, alkyl or alkoxy, the alkyl and alkoxy not exceeding four carbon atoms in size, and all may be the same or different. Typical compounds coming within the group are succinimide and maleimide, such that the silver imide complex maintains solubility adequate to keep silver in solution at plating concentration. Useful and commercially available imides in addition include, illustratively, 3,3-dimethyl succinimide; 3-methyl-3-ethyl succinimide.

Because of the novel brightener, the plating characteristics of the aqueous electroplating baths with emphasis on brightness are vastly improved over existing bright non-cyanide silver plating electrolytes. Furthermore, silver and silver alloy deposits obtained from the above mentioned electrolyte in the presence of the new brightener are at least equal to, or better than, silver or silver alloy deposits obtained from conventional cyanide bright plating silver and silver alloy baths.

The following amines, imines, polyamines, or polyimines of common formulas may be used as potent or effective brighteners in our previously described non-cyanide silver plating baths:

1. $RC_nH_{2n}R_1$ amines and imines
   wherein
   R is $—NH_2$
   $R_1$ is $—NH_2$ or —H
   $n$ is 2 to 6
2. R $(C_mH_{2m}NR)_xR'_{x-1}$ R″ polyamines and polyimines
   wherein
   R is $—NH_2$
   R″ is H or lower alkyl
   R′ is hydrogen, alkyl, alkoxyl, or their amine or imine derivatives, the lower alkyl or alkoxyl containing 2 – 6 carbon atoms, and
   $x$ is 1 to 8
   $m$ is 2 to 6
3. or formula as in No. 2 in which there is 25 to 50% cross linking; for example polyethylene imine, or poly propylene imine, from molecular weight 100 to 60,000. These compounds are commercially available as polyimines of various molecular weights from 100 to 600,000 from the Dow Chemical Company, Midland, Michigan.

BACKGROUND OF THE INVENTION

This invention relates to the electrodeposition of silver and silver alloys and more particularly to the improved electrodeposition of silver and silver alloys with up to 5 percent alloying metal, employing soluble or insoluble anodes.

In the conventional electrolytic silver plating baths, the electrolytes have almost always been limited to cyanide types because of the high stability constant of the complex $K[Ag(CN)_2]$.

Conventional potassium silver cyanide plating solutions excel in current efficiency, brightness of the silver and silver alloy deposit, throwing power and speed of electrodeposition.

These features of the cyanide silver and silver alloy plating electrolytes are due to the presence of $CN^-$ ions in the solutions and very effective organic and/or inorganic brighteners.

Such $CN^-$ ions react to form poisonous HCN. For this reason constant care must be taken and efficient ventilization supplied. Another disadvantage is the presence of $CN^-$ ions near to or directly on the anode and especially on an insoluble anode where ammonia and potassium carbonate are formed.

Because of the accumulation of potassium carbonate in the electrolyte, very costly and complicated processes must be applied to remove an excess of such by-product.

Thus, because of its very high toxicity and, other reason, the art of silver and silver alloy electroplating tries to avoid the use of cyanide compounds.

It is an object of this invention to provide a non-cyanide silver plating bath which will readily deposit a uniform, bright, pure silver or silver alloy layer over a variety of conductive surfaces.

It is another object to achieve good adhesion of silver and silver alloy deposits to copper and copper alloys without the application of a silver strike prior to actual silver plating, thereby eliminating one or two processing steps.

At the present time most patents direct to non-cyanide silver plating baths are based on ammonia complexes of silver in combination with a variety of conductivity salts.

These include:

U.S. Pat. Nos. 2,504,272; 3,406,107; 3,362,895; 3,507,758;

Russian Pat. Nos. 138,788; 199,261; 203,423; 212,690; 337,435;

Japanese Pat. JA No. 703,9945; British Pat. No. 1,047,789.

Some silver formulations employ amide and amine complexes. These include:

Russian Pat. Nos.: 185,659; 212,689; 295,824; 312,892, and all of these are to be considered incorporated herein. None of these patented formulations has found industrial application because the silver complex is unstable during extended periods of time; the breakdown of electrolyte during electrolysis, the poor quality of the silver deposit and an extremely low useful current density range.

It is an object of this invention to produce mirror bright silver and silver alloy electroplates which are equal to or better than presently used cyanide containing silver plating baths.

It is also the object of the invention to produce mirror bright silver and silver alloy deposits over wide ranges of current densities.

It is further among the objects of the invention to provide a non-cyanide silver plating bath which is able to produce pure mirror bright silver deposit without any alloying metals.

These and other objects will become apparent from the following description of the present invention.

This invention is concerned with the electrodeposition of silver and silver alloy deposits, using a non-cyanide electrolyte formulation. In accordance with this invention, and the examples which follow, we provide an electrolyte where silver is present in complexes with organic compounds of the following:

For example:
Succinimide
3-methyl-3-ethyl
3-methyl succinimide
3-ethyl succinimide
3,3,4,4-tetramethyl succinimide
3,3,4-trimethyl succinimide
maleimide In our invention, silver is bonded in a complex with succinimide and its derivatives or compounds resulting from those described herein. It is used as a reaction product of water soluble silver salt and the imide without separation of a pure compound.

The ratio of silver to the complexing agent is 1 mol of silver to two mols of complexing compounds, but may be different in accordance with complexing agent used.

The alkali metal silver complex is soluble in water if the pH is adjusted from 6.0 to 14. However, the pH value may vary slightly in accordance with use of complexing compound and alkali metal.

According to our invention, the new non-cyanide silver and silver alloy plating bath contains (1) succinimide, or its derivatives, or compounds of related common formulas described in accordance with this invention, (2) alkali metal or ammonium hydroxide, (3) soluble or insoluble silver salt, (4) optional conductivity salt or salts, (5) alloying metal salt, and (6) brighteners which can be employed alone or in conjunction one with another.

The non-cyanide silver and silver alloy plating bath works at temperatures between 20° - 40° C (68° - 103° F) and cathodic current density between 0.1-3A per square decimeter (1-30 amperes per square foot). The cathode area to anode area ratio should not be lower than 1:1, but extremely high ratios, of 1:10 and more, could be advantageous. Cathode current efficiency, regardless of anodes used, is 90 to 100%.

Anode current efficiency in the case of soluble silver anodes is 90 to 100%.

During the electrolysis of the non-cyanide silver plating bath, the silver complex is the source of silver ions and, later, liberated succinimide serves as a complexing agent to bond the silver dissolved from the soluble silver anode. In the case of insoluble anodes, liberated succinimide serves as a complexing agent for a water soluble or insoluble silver replenishing salt.

The ratio of silver ions to succinimide should be about 1.0: 2.0, but can be as high as 1: saturation point. The concentration of conductivity salts which form a soluble silver salt is not critical. The concentration of conductivity salts which form an insoluble silver compound is also not critical, up to the point where it interferes with the solubility of silver anodes during the electroplating process.

Consequently, in accordance with this invention, it has been found that mirror bright silver deposit can be achieved by incorporating alkylene, alkylol or alkanol amines into non-cyanide silver plating baths based on silver complexes described herein.

Besides the above mentioned amines, the same but in some cases even improved results can be achieved by using alkylene polyamines, which contain at least one secondary amino group and at least one primary amino group, or polyimine compounds having molecular weights in the range from about 100 to 60,000 with emphasis on the lower molecular weight range from about 100 to 2,000. The most active polyimines are polymers called polyethyleneimines which are formed by polymerization of ethyleneimines, substituted ethyleneimines, or derived from the addition of ethyleneimine to organic or inorganic molecules.

Accordingly, with the present invention, the non-cyanide mirror bright silver plating bath consists of a composition as follows:

| | | |
|---|---|---|
| (1) | Silver as succinimide complex | 5 to 100 grams per liter |
| (2) | Succinimide or its derivatives | 10 grams per liter to saturation |
| (3) | Conductivity salt | 0 to 300 grams per liter |
| (4) | Alkali metal/hydroxide or ammonium/hydroxide | 5 to 200 grams per liter |
| (5) | Brightener | 0.001 to 50 grams per liter |
| (6) | Alloying metal | 0 to 5 mol percent |
| | Water | to 1 liter |
| | pH | 6.0 to 14 |

According to this invention, the following compounds and their derivatives can be used as brighteners for non-cyanide silver plating bath:

| | |
|---|---|
| polyethylene imines<br>polypropylenes imines<br>polyhdroxyethylene-imines | in the molecular weight range defined |
| poly (hydroxyethyl ethyleneimines) | |
| ethyl amines | |
| propylamine | |
| ethylenediamine | |
| propylenediamine | |
| diethylenediamine | |
| triethylenetetramine | |
| tetraethylenepentamine | |
| pentaethylenehexamine | |
| imino-bis-propylamine | |
| dimethyl amine propylamine | |
| diethylpropylenediamine | |

The above described amine or imino compounds can be used in a non-cyanide silver plating formulation based on siler succinimide complexes as a single compound or combined with each other.

Similarly, the following alloying metals are useful: copper, cadmium, gold, palladium and antimony.

A variety of conductivity salts can be used: $NO_2^-$, $OH^-$, $NO_3^-$, $F^-$, $CO_3^{--}$, $PO_4^{---}$, $HPO_4^{--}$, $SO_3^{--}$, $SO_4^{--}$, $NH_2SO_3^-$, mono-, di-, or tricarboxylic acids and their hydroxy or amine derivatives. The operating characteristics of the aqueous electroplating baths, such as the maximum current density, the cathode current efficiency, the width of the pH range, the brightness of silver or silver alloy deposit and the stability of the electrolyte are vastly improved over existing non-cyanide silver and silver alloy plating electrolytes. Furthermore, silver and silver alloy deposits from the above mentioned electrolytes are at least equal to or better than a silver, or silver alloy deposit obtained from conventional cyanide electrolyte, with excellent adhesion when applied over brass and copper without a preliminary silver strike.

The following specific examples illustrate the formulation of the baths:

EXAMPLE I

An aqueous non-cyanide silver electroplating bath is prepared as follows:

| | |
|---|---|
| Ag as succinimide complex | 22.5 grams per liter |
| Succinimide | 11.5 grams per liter |
| Potassium nitrate | 7.5 grams per liter |
| Triethylene tetramine | 0.5 milliliters per liter |

The pH was adjusted with potassium hydroxide to 8.5. The electrolyte was moderately agitated at a temperature of 25° C (77° F). Sample was plated 10 minutes at $1A.dm^{-2}$ (10 ASF). Resulting deposit was mirror bright and stress free.

EXAMPLE 2

An aqueous non-cyanide silver electroplating bath is prepared as follows:

| | |
|---|---|
| Ag as succinimide complex | 22.5 grams per liter |
| Succinimide | 11.5 grams per liter |
| Polyethyleneimine - 18 | 0.4 grams per liter |
| Polyethylene glycol - 6000 (wetting agent) | 0.15 grams per liter |

The pH was adjusted with potassium hydroxide to 8.5. The electroltye was moderately agitated at a temperature of 25° C (77° F). Sample was plated 10 minutes at $1.5A.dm^{-2}$ (15 ASF). Resulting deposit was mirror bright and stress free.

EXAMPLE 3

An aqueous non-cyanide silver electroplating bath is prepared as follows:

| | |
|---|---|
| Ag as succinimide complex | 22.5 grams per liter |
| Succinimide | 11.5 grams per liter |
| Polyethylenimine -12 | 0.1 gram per liter |

The pH was adjusted with sodium hydroxide to 6.5. Sample was plated 10 minutes at $0.5A.dm^{-2}$ (5 ASF) under same conditions as in Examples 1 and 2. Bright deposit was obtained with very slight blue hue.

EXAMPLE 4

An aqueous non-cyanide silver electroplating bath is prepared as follows:

| | |
|---|---|
| Ag as succinimide complex | 30 grams per liter |
| Succinimide | 11.5 grams per liter |
| Potassium nitrite | 37 grams per liter |
| Ethylene diamine | 2 milliliters per liter |

The pH was adjusted with potassium hydroxide to 9. The electrolyte was moderately agitated at a temperature of 25° C (77° F). Sample was plated 10 minutes at $1.5A.dm^{-2}$ (15 ASF). Deposit was mirror bright and stress free.

EXAMPLE 5

An aqueous non-cyanide silver electroplating bath is prepared as follows:

| | |
|---|---|
| Ag as succinimide | 22.5 grams per liter |
| Succinimide | 37 grams per liter |
| Potassium fluoride | 37 grams per liter |
| 1,6 -hexanediamine | 4 milliliters per liter |

The pH was adjusted with potassium hydroxide to pH 10. The electrolyte was moderately agitated at temperature of 25° C (77° F). Sample was plated at $1A.dm^{-2}$ (10 ASF) for 10 minutes. Resulting deposit was bright and stress free.

EXAMPLE 6

An aqueous non-cyanide silver electroplating bath is prepared as follows:

| | |
|---|---|
| Ag as succinimide complex | 37 grams per liter |
| Succinimide | 22.5 grams per liter |
| Wetting agent FC-95 | .1 gram per liter |
| Triethylenetetramine | 0.8 milliliter per liter |

The pH was adjusted to 9 with potassium hydroxide. The electrolyte was moderately agitated at temperature 25° C (77° F). Sample was plated at $0.7A.dm^{-2}$ (7 ASF) for 20 minutes. Deposit was mirror bright and stress free.

EXAMPLE 7

An aqueous non-cyanide silver electroplating bath is prepared as follows:

| | |
|---|---|
| Ag as succinimide complex | 22.5 grams per liter |
| Succinimide | 11.5 grams per liter |
| Potassium sulfate | 45 grams per liter |
| Tetraethylene pentamine | 0.4 gram per liter |

The pH was adjusted with potassium hydroxide to 8.5. The electrolyte was moderately agitated. Sample was plated at temperature 25° C (77° F) for 10 minutes at $1A.dm^{-2}$ (10 ASF). Resulting deposit was mirror bright and stress free.

EXAMPLE 8

An aqueous non-cyanide silver electroplating bath is prepared as follows:

| | |
|---|---|
| Ag as succinimide complex | 22.5 grams per liter |
| Succinimide | 11.5 grams per liter |
| Polyethyleneimine-18 | 0.5 gram per liter |
| Ethylenediamine | 2 milliliters per liter |

The pH was adjusted to 10 with KOH. The electrolyte was moderately agitated. Sample was plated at temperature 25° C (77° F) for 10 minutes at $1A.dm^{-2}$ (10 ASF). Resulting deposit was mirror bright and stress free.

EXAMPLE 9

An aqueous non-cyanide silver electroplating bath is prepared as follows:

| | |
|---|---|
| Ag as succinimide complex | 22.5 grams per liter |
| Succinimide | 22.5 grams per liter |
| Hexamethylene tetramine | 0.1 gram per liter |

-continued

| | |
|---|---|
| Polyethylene glycol - 1500 | 1 gram per liter |

The pH was adjusted to 9 with potassium hydroxide. The electrolyte was moderately agitated at a temperature of 30° C (86° F). Sample was plated 10 minutes at $1A.dm^{-2}$ (10 ASF). Resulting deposit was bright and stress free.

EXAMPLE 10

An aqueous non-cyanide silver electroplating bath is prepared as follows:

| | |
|---|---|
| Ag as succinimide complex | 22.5 grams per liter |
| Succinimide | 22.5 grams per liter |
| Diethylenetriamine | 5 milliliters per liter |
| Wetting agent FC-170 | 1 gram per liter |

The pH was adjusted with potassium hydroxide to 11. The electrolyte was moderately agitated at a temperature of 25° C (77° F). Sample was plated 10 minutes at $1A.dm^{-2}$ (10 ASF). Resulting deposit was bright and stress free.

EXAMPLE 11

An aqueous non-cyanide silver electroplating bath is prepared as follows:

| | |
|---|---|
| Ag as AgNO3 | 36 grams per liter |
| Succinimide | 55 grams per liter |
| Potassium nitrate | 50 grams per liter |
| Polyethylene glycol - 6000 | 0.5 grams per liter |

Potassium hydroxide was used to adjust the pH to 9.5. Sample was plated at temperature of 30° C (86° F) and current density $1A.dm^{-2}$ (10 ASF) for 10 minutes. The resulting deposit was uniformly semibright to bright.

EXAMPLE 12

| | |
|---|---|
| Ag as succinimide complex | 22.5 grams per liter |
| Succinimide | 22.5 grams per liter |
| Potassium nitrite | 20 grams per liter |
| Ethylene diamine | 2 milliliters per liter |

The pH was adjusted to a pH 9.5 with potassium hydroxide. The electrolyte was moderately agitated at a temperature of 25° C (77° F). Sample was plated 10 minutes at 1.5 A $dm^2$ (15 ASF). The resulting deposit was mirror bright and stress free.

EXAMPLE 13 ETC.

It is to be understood that the silver can be present in the plating solution in any of the imide complexes developed, namely, the succinimide, maleimide, or the methyl ethyl succinimide variants we have indicated. They are commercially available and can be used in the several examples at the several concentrations indicated.

The general formula of polyamines or polyimines has been listed and the products are commercially available.

In the examples given, the concentration may be considered illustrative of optimal operation, but concentrations may be varied from those which have been indicated.

EXAMPLE 14

| | |
|---|---|
| Ag as $AgNO_3$ | 23 grams per liter |
| $Cu^{++}$ as $Cu(NO_3)_2—3H_2O$ | 1.5 grams per liter |
| Succinimide | 80 grams per liter |
| Potassium nitrite | 40 grams per liter |
| pH adjusted with potassium hydroxide to | 8.5 |
| Temperature | 25° C (77° F) |
| Current density | $1A . dm^{-2}$ (10 ASF) |
| Plating time | 10 minutes |
| Deposit | 97% Ag, 3% Cu-mirror bright |
| Current efficiency | 97% |

EXAMPLE 15

| | |
|---|---|
| Ag as Ag $NO_3$ | 23 grams per liter |
| $Cu^{++}$ as Cu Cl | 1.5 grams per liter |
| Succinimide | 70 grams per liter |
| Potassium nitrite | 30 grams per liter |
| pH Adjusted with potassium hydroxide to | 8.5 |
| Temperature | 25°C (77° F) |
| Current density | $1.5A . dm^{-2}$ (15 ASF) |
| Plating time | 10 minutes |
| Deposit | 95% Ag, 5% Cu-mirror bright |
| Current efficiency | 97% |

EXAMPLE 16

| | |
|---|---|
| Ag as Silver succinimide complex | 22.5 grams per liter |
| Cu as Copper succinimide complex | 1.5 grams per liter |
| Succinimide | 25 grams per liter |
| pH adjusted with potassium hydroxide to | 9.0 |
| Temperature | 25° C (77° F) |
| Current density | $0.8 A . dm^{-2}$ (8ASF) |
| Plating time | 10 minutes |
| Deposit | 98% Ag, 2% Cu-mirror bright |
| Current efficiency | 97% |

EXAMPLE 17

| | |
|---|---|
| Ag as Silver succinimide complex | 23 grams per liter |
| $Cu^{++}$ as copper acetate | 1 gram per liter |
| Succinimide | 70 grams per liter |
| pH adjusted with potassium hydroxide to | 8.5 |
| Temperature | 25° C (77° F) |
| Current density | $1.0A . dm^{-2}$ (10 ASF) |
| Plating time | 10 minutes |
| Deposit | 97% Ag, 3% Cu-mirror bright |
| Current efficiency | 96% |

EXAMPLE 18

| | |
|---|---|
| Ag as Silver succinimide complex | 23 grams per liter |
| $Cd^{++}$ as Cd $(NO_3)2$ | 1.5 grams per liter |
| succinimide | 45 grams per liter |
| Potassium nitrate | 7 grams per liter |
| pH adjusted with potassium hydroxide to | 9.5 |
| Temperature | 20° C (68° F) |
| Current density | $1.0A . dm^{-2}$ (10 ASF) |
| Plating time | 10 minutes |
| Deposit | 98% Ag, 2% Cd-mirror bright |
| Current efficiency | 98% |

EXAMPLE 19

| | |
|---|---|
| Ag as $AgNO_3$ | 23 grams per liter |
| $Cd^{++}$ as Cadmium acetate | 2 grams per liter |
| Succinimide | 65 grams per liter |
| Potassium acetate | 20 grams per liter |
| pH adjusted with potassium hydroxide to | 9.0 |
| Temperature | 20° C (68° F) |
| Current density | 1.5A . $dm^{-2}$ (15 ASF) |
| Plating time | 10 minutes |
| Deposit | 97% Ag, 3% Cd-mirror bright |

EXAMPLE 20

| | |
|---|---|
| Ag as $AgNO_3$ | 20 grams per liter |
| $Cd^{++}$ as Cd $(NO_3)2$ | 23 grams per liter |
| Succinimide | 120 grams per liter |
| Potassium nitrite | 37 grams per liter |
| pH adjusted with potassium hydroxide to | 8.5 |
| Temperature | 25° C (77° F) |
| Current density | 1.0A . $dm^{-2}$ (10 ASF) |
| Plating time | 10 minutes |
| Deposit | 96.2% Ag, 3.8% Cd-mirror bright |

EXAMPLE 21

| | |
|---|---|
| Ag as Silver succinimide complex | 23 grams per liter |
| $Au^{+++}$ as H Au $Cl_4$ | 1.2 grams per liter |
| Succinimide | 30 grams per liter |
| Potassium citrate | 25 grams per liter |
| pH adjusted with potassium hydroxide to | 8.7 |
| Temperature | 25° C (77° F) |
| Current density | 2.0A . $cm^{-2}$ (20 ASF) |
| Plating time | 10 minutes |
| Deposit | 97.5% Ag, 2.5% Au-bright |

EXAMPLE 22

| | |
|---|---|
| Ag as $AgNO_3$ | 23 grams per liter |
| $Sb^{+++}$ as Antimony tartrate | 2 grams per liter |
| Succinimide | 65 grams per liter |
| Triethanolamine | 5 milliliters per liter |
| pH adjusted with potassium hydroxide to | 12.5 |
| Temperature | 25° C (77° F) |
| Current density | 1.5A . $dm^{-2}$ (15 ASF) |
| Plating time | 10 minutes |
| Deposit | 97% Ag, 3% Sb-dark-bright |
| Current efficiency | 90% |

EXAMPLE 23

| | |
|---|---|
| Ag as Ag $NO_3$ | 23 grams per liter |
| Pd as Palladium ethylene diamine sulfate | 4 grams per liter |
| Succinimide | 65 grams per liter |
| pH adjusted with sodium hydroxide to | 8.0 |
| Temperature | 25° C (77° F) |
| Current density | 1.0A . $dm^{-2}$ (10 ASF) |
| Plating time | 10 minutes |
| Deposit | bright |
| Current efficiency | 95% |

EXAMPLE 24

| | |
|---|---|
| Ag as $AgNO_3$ | 23 grams per liter |
| $Cu^{++}$ as Cu $(NO_3)_2 . 3H_2O$ | 23 grams per liter |

-continued

| | |
|---|---|
| Succinimide | 120 grams per liter |
| Potassium nitrite | 37 grams per liter |
| pH adjusted with potassium hydroxide to | 8.5 |
| Temperature | 25° C (77° F) |
| Current density | 1.0A . $dm^{-2}$ (10 ASF) |
| Plating time | 10 minutes |
| Deposit | 98.3% Ag, 1.7% Cu-bright |
| Current efficiency | 20% |

EXAMPLE 25

| | |
|---|---|
| Ag as $AgNO_3$ | 23 grams per liter |
| $Cu^{++}$ as Cu $(NO_3)_2 . 3H_2O$ | 30 grams per liter |
| Succinimide | 150 grams per liter |
| Potassium nitrite | 37 grams per liter |
| pH adjusted with potassium hydroxide to | 8.5 |
| Temperature | 25° C (77° F) |
| Current density | 4A . $dm^{-2}$ (40 ASF) |
| Plating time | 10 minutes |
| Deposit | 85.0% Ag, 15% Cu-bright |

EXAMPLE 26

| | |
|---|---|
| Ag as $AgNO_3$ | 23 grams per liter |
| $Cd^{++}$ as Cd $(NO_3)_2$ | 30 grams per liter |
| Succinimide | 150 grams per liter |
| pH adjusted with potassium hydroxide to | 8.5 |
| Temperature | 25° C (77° F) |
| Current density | 2.0A . $dm^{-2}$ (20 ASF) |
| Plating time | 10 minutes |
| Deposit | 78% Ag, 22% Cd-dark bright |

EXAMPLE 27

| | |
|---|---|
| Ag as $AgNO_3$ | 23 grams per liter |
| $Au^{+++}$ as H $AuCl_4$ | 20 grams per liter |
| Succinimide | 140 grams per liter |
| pH adjusted with potassium hydroxide to | 10.0 |
| Temperature | 30° C (86° F) |
| Current density | 1.0A . $dm^{-2}$ (10 ASF) |
| Plating time | 10 minutes |
| Deposit | 99.5% Ag, 0.5% Au-semi bright |

EXAMPLE 27-A

| | |
|---|---|
| Silver as silver nitrate | 15 grams per liter |
| Maleimide | 36 grams per liter |
| pH-adjusted with $NH_4OH$ | 10.0 |
| Temperature | 20° C |
| Current Density | 1.0A/$dm^2$ |
| Plating time | 5 minutes |
| Deposit | Silver-semi bright to dull |

EXAMPLE 28

| | |
|---|---|
| Ag as $AgNO_3$ | 25 grams per liter |
| $Pd^{++}$ as Palladium ethylene diamine sulfate | 16 grams per liter |
| Succinimide | 260 grams per liter |
| pH adjusted with potassium hydroxide to | 9.0 |
| Temperature | 25° C (77° F) |
| Current density | 1.0A . $dm^{-2}$ (10 ASF) |
| Plating time | 10 minutes |
| Deposit | Semi bright |

EXAMPLE 29 ETC.

Accordingly, with the present invention, the new non-Cyanide Mirror Bright Silver Alloy Plating Bath consists of the following:

| | |
|---|---|
| Silver | 5 grams to 100 grams per liter |
| Succinimide | 10 grams to saturation point |
| Conductivity salt | 0 grams to saturation point |
| Alkali Metal or $NH_4OH$ hydroxide and one of the following metals or their combination | 5 grams to 200 grams per liter |

with each other:

| | |
|---|---|
| $Cu^{+}$ | 0.1 gram to 40 grams per liter |
| $Cu^{++}$ | 0.1 gram to 40 grams per liter |
| $Cd^{++}$ | 0.1 gram to 40 grams per liter |
| $Au^{+}$ | 0.1 gram to 40 grams per liter |
| $Au^{+++}$ | 0.1 gram to 40 grams per liter |
| $Pd^{++}$ | 0.1 gram to 20 grams per liter |
| $Sb^{+++}$ | 0.1 gram to 40 grams per liter |
| Water | to 1 liter |
| pH | 6.0 to 14 |

In the preceding examples we have shown how to deposit mirror bright silver and silver alloy electroplates from the non-cyanide complex. This can be done with or without the polyamine or polyimine brighteners. Coloring and brightening of the silver plate can be achieved by alloying with co-plated metals in an amount from a few parts per thousand to about 5% of alloyed deposit.

As can be seen from the foregoing examples, a silver alloy plate can be prepared from the succinimide plating bath with very satisfactory results over a good range of concentrations, temperatures, and pH.

What is claimed is:

1. A reaction product of a water-soluble silver-salt and pyrrolidine-2,5-dione or a 3-pyrroline 2,5-dione to form a complex which is itself water-soluble.

2. In an aqueous electrolytic solution having a pH of 6 to 14, and free of cyanide, for use in electrodeposition of silver and silver alloys, the improvement that comprises a water-soluble silver complex formed from the reaction of a silver salt and an organic complexing agent selected from a pyrrolidine-2,5 dione of the formula:

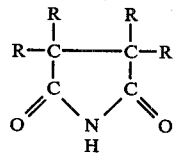

or a 3-pyrroline-2,5-dione of the formula:

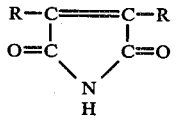

wherein R is, in each instance of its occurrence in each of the foregoing formulae, the same or different from its other instances of occurrence, and is hydrogen or an alkyl or alkoxy moiety, said alkyl or alkoxy moiety containing from 1 to 4 carbon atoms.

3. An aqueous electrolytic solution as claimed in claim 2 wherein said silver salt is present in a ratio of one mole equivalent thereof to at least two moles of said organic complexing agent.

4. An electrolytic solution as claimed in claim 3 wherein said silver salt is present in a ratio of one mole thereof to two moles of said complexing agent.

5. An aqueous electrolytic solution as claimed in claim 2 wherein said organic complexing agent is a pyrrolidine-2,5-dione.

6. A aqueous electrolytic solution as claimed in claim 5 wherein said pyrrolidine-2,5-dione is succinimide.

7. An aqueous electrolytic solution as claimed in claim 2 wherein said organic complexing agent is a 3-pyrroline-2,5-dione.

8. An aqueous electrolytic solution as claimed in claim 7 wherein said 3-pyrroline-2,5-dione is maleimide.

9. An aqueous cyanide-free electroplating bath for the electrodeposition of silver and silver alloys comprising:

a water-soluble silver complex formed by reaction of a silver salt with an organic complexing agent selected from a pyrrolidine-2,5-dione of the formula:

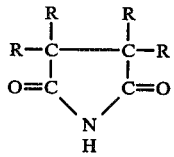

or a 3-pyrroline-2,5-dione of the formula:

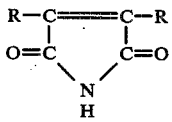

wherein R is, in each instance of its occurrence in each of the foregoing formulae, the same or different from its other instances of occurrence, and is hydrogen or an alkyl or alkoxy moiety; said alkyl or alkoxy moiety containing from 1 to 4 carbon atoms and at least one brightener component; said bath having a pH from 6 to 14 inclusive.

10. An aqueous, cyanide-free, electroplating bath as claimed in claim 9 wherein said pyrrolidine-2,5-dione is succinimide.

11. An aqueous, cyanide-free, electroplating bath as claimed in claim 10 wherein at least one brightener component is present.

12. An aqueous, cyanide-free, electroplating bath as claimed in claim 11 wherein said brightener component is an amine or polyamine.

13. An aqueous, cyanide-free electroplating bath as claimed in claim 18 wherein said bath includes a water-soluble alloying metal.

14. An aqueous, cyanide-free electroplating bath as claimed in claim 13 wherein said bath includes as a principal brightener, an amine or polyamine.

15. An aqueous, cyanide-free, electroplating bath as claimed in claim 9 wherein said 3-pyrroline-2,5-dione is maleimide.

16. An aqueous, cyanide-free, electroplating bath as claimed in claim 9 wherein said pyrrolidine-2,5-dione is 3-methyl-3-ethyl succinimide.

17. An aqueous, cyanide-free, electroplating bath as claimed in claim 9 wherein said pyrrolidine-2,5-dione is 3-methyl succinimide.

18. An aqueous, cyanide-free, electroplating bath as claimed in claim 9 wherein said pyrrolidine-2,5-dione is 3-ethyl succinimide.

19. An aqueous, cyanide-free, electroplating bath as claimed in claim 9 wherein said pyrrolidine-2,5-dione is 3,3,4,4-tetramethyl succinimide.

20. An aqueous, cyanide-free, electroplating bath as claimed in claim 9 wherein said pyrrolidine-2,5-dione is 3,3,4-trimethyl succinimide.

21. An aqueous, cyanide-free, electroplating bath as claimed in claim 9 wherein said pyrrolidine-2,5-dione is 3,3-dimethyl succinimide.

22. An aqueous, cyanide-free, electroplating bath as claimed in claim 9 wherein said pyrrolidine-2,5-dione is 3-methyl ethyl succinimide.

23. An aqueous cyanide-free electroplating bath as claimed in claim 9 wherein said silver is present in a ratio of one mole equivalent thereof to at least 2 moles of said organic complexing agent; said complex being water-soluble.

24. An aqueous cyanide-free electroplating bath as claimed in claim 9 wherein said bath includes as a principal brightener component, an amine or polyamine.

25. An aqueous cyanide-free electroplating bath as claimed in claim 24 wherein said bath includes a conductivity salt containing as its anionic constituent $NO_2^-$, $OH^-$, $NO_3^-$, $F^-$, $CO_3^{--}$, $HCO_3^-$, $PO_4^{---}$, $HPO_4^{--}$, $H_2PO_4^-$, $SO_3^{--}$, $SO_4^{--}$, $HSO_4^-$, or $NH_2SO_3^-$.

26. An aqueous, cyanide-free electroplating bath as claimed in claim 24 wherein said principal brightener component is present in said bath in a concentration of 0.001 gram to 50 grams per liter.

27. An aqueous, cyanide-free electroplating bath as claimed in claim 26 wherein said brightener is an alkylene polyamine or a polyalkylene polyamine.

28. An aqueous, cyanide-free electroplating bath as claimed in claim 9 wherein said bath includes a water-soluble salt of a metallic brightener or an alloying metal selected from copper, cadmium, gold, palladium or antimony.

29. An aqueous cyanide-free electroplating bath as claimed in claim 9 wherein the molar ratio of silver to said succinimide is 1:2 respectively; and the concentration of silver present in said bath in the form of its succinimide complex is from 5 grams to 100 grams per liter.

30. An aqueous, cyanide-free electroplating bath as claimed in claim 9 wherein said bath includes as a basic component, an alkali metal hydroxide or ammonium hydroxide.

31. An aqueous, cyanide-free electroplating bath as claimed in claim 30 wherein said basic component is alkali metal hydroxide.

32. An aqueous, cyanide-free electroplating bath as claimed in claim 30 wherein said basic component is ammonium hydroxide.

33. In a process for the electrodeposition of silver and silver alloys by passing an electric current to a cathode to be plated, the improvement that comprises passing said current through an electroplating bath that comprises an aqueous solution having a pH of from 6 to 14 inclusive of a water-soluble silver complex formed by reaction of a silver salt and an organic complexing agent selected from a pyrrolidine-2,5-dione of the general formula:

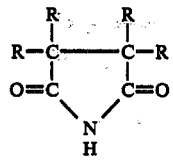

or a 3-pyrroline-2,5-dione of the formula:

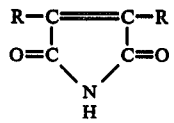

wherein R is, in each instance of its occurrence in each of the foregoing formulae, the same or different from its other instances of occurrence, and is hydrogen or an alkyl or alkoxy moiety, said alkyl or alkoxy moiety containing from 1 to 4 carbon atoms.

34. A process as claimed in claim 33 wherein said pyrrolidine-2,5-dione is succinimide.

35. A process as claimed in claim 33 wherein said 3-pyrrolidine-2,5-dione is maleimide.

36. The process that comprises reacting one mole of a silver salt with at least two moles of a pyrrolidine-2,5-dione of the formula:

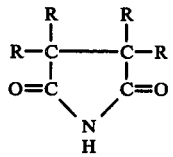

or a 3-pyrroline-2,5-dione of the formula:

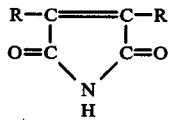

where, in each of the foregoing formulae, R is, in each instance of its occurrence, the same or different from its other instances of occurrence, and is hydrogen or an alkyl or alkoxy radical; each of said alkyl and alkoxy radicals containing from 1 to 4 carbon atoms.

37. A process as claimed in claim 36 wherein said pyrrolidine-2,5-dione is succinimide.

38. A process as claimed in claim 36 wherein said 3-pyrroline-2,5-dione is maleimide.

39. A complex of silver and, as a complexing agent, a pyrrolidine-2,5-dione of the formula:

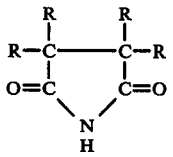

or a —-pyrroline-2,5-dione of the formula:

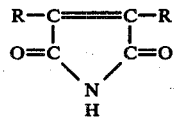

where, in each of the foregoing formulae, R is, in each instance of its occurrence, the same or different from its other instances of occurrence, and is hydrogen or an alkyl or alkoxy radical; each of said alkyl and alkoxy radicals containing from 1 to 4 carbon atoms; formed by reaction of one mole of a silver salt with at least two moles of said complexing agent.

40. A complex as claimed in claim 39 wherein said pyrrolidine-2,5-dione is succinimide.

41. A complex as claimed in claim 39 wherein said 3-pyrroline-2,5-dione is maleimide.

* * * * *